US009127463B1

(12) United States Patent
Feldhaus

(10) Patent No.: US 9,127,463 B1
(45) Date of Patent: Sep. 8, 2015

(54) GUTTER DEBRIS COVER

(71) Applicant: Daniel E. Feldhaus, Monticello, IN (US)

(72) Inventor: Daniel E. Feldhaus, Monticello, IN (US)

( * ) Notice: Subject to any disclaimer, the term of this patent is extended or adjusted under 35 U.S.C. 154(b) by 0 days.

(21) Appl. No.: 14/492,856

(22) Filed: Sep. 22, 2014

(51) Int. Cl.
*E04D 13/00* (2006.01)
*E04D 13/076* (2006.01)
*E04B 1/92* (2006.01)

(52) U.S. Cl.
CPC ..... *E04D 13/076* (2013.01); *E04B 1/92* (2013.01)

(58) Field of Classification Search
CPC ..... E04D 13/076
USPC ..... 52/11, 12
See application file for complete search history.

(56) References Cited

U.S. PATENT DOCUMENTS

| | | | | |
|---|---|---|---|---|
| 2,209,741 | A * | 7/1940 | Sullivan et al. | 210/474 |
| 2,672,832 | A | 1/1951 | Goetz | |
| 4,815,888 | A | 3/1989 | Stegmeier | |
| 4,941,299 | A * | 7/1990 | Sweers | 52/12 |
| 4,959,932 | A * | 10/1990 | Pfeifer | 52/12 |
| 5,109,640 | A * | 5/1992 | Creson | 52/12 |
| 5,271,192 | A * | 12/1993 | Nothum et al. | 52/12 |
| 5,406,754 | A * | 4/1995 | Cosby | 52/12 |
| 5,755,061 | A * | 5/1998 | Chen | 52/12 |
| 5,956,904 | A | 9/1999 | Gentry | |
| 6,134,843 | A * | 10/2000 | Tregear | 52/12 |
| 6,598,352 | B2 * | 7/2003 | Higginbotham | 52/12 |
| 6,951,077 | B1 * | 10/2005 | Higginbotham | 52/12 |
| 7,174,688 | B2 | 2/2007 | Higginbotham | |
| 7,191,564 | B2 | 3/2007 | Higginbotham | |
| 7,627,991 | B1 | 12/2009 | Feldhaus | |
| 7,913,458 | B2 | 3/2011 | Higginbotham | |
| 8,006,438 | B2 | 8/2011 | Higginbotham | |
| RE42,896 | E | 11/2011 | Higginbotham | |
| RE43,555 | E | 7/2012 | Higginbotham | |
| 8,276,321 | B2 * | 10/2012 | Bell | 52/12 |
| 8,312,677 | B2 | 11/2012 | Higginbotham | |
| 8,375,644 | B2 * | 2/2013 | Robins | 52/12 |
| 8,397,436 | B2 | 3/2013 | Higginbotham | |
| 8,474,192 | B2 * | 7/2013 | Horton | 52/12 |
| 2001/0037610 | A1 * | 11/2001 | Davis | 52/12 |
| 2004/0000098 | A1 | 1/2004 | Knudson | |
| 2006/0053697 | A1 | 3/2006 | Higginbotham | |
| 2006/0123710 | A1 | 6/2006 | Lenney et al. | |
| 2006/0179723 | A1 * | 8/2006 | Robins | 52/11 |
| 2006/0230687 | A1 * | 10/2006 | Ealer | 52/12 |
| 2007/0017175 | A1 | 1/2007 | Tamlyn | |
| 2010/0287846 | A1 * | 11/2010 | Lenney | 52/12 |
| 2011/0056145 | A1 * | 3/2011 | Lenney et al. | 52/12 |
| 2012/0042579 | A1 * | 2/2012 | McCoy | 52/12 |
| 2012/0110922 | A1 * | 5/2012 | Hawes | 52/12 |
| 2012/0110923 | A1 * | 5/2012 | Robins | 52/12 |

(Continued)

FOREIGN PATENT DOCUMENTS

| | | |
|---|---|---|
| DE | 3804541 | 7/1988 |
| JP | 108661 | 1/1998 |
| JP | 2001342721 | 12/2001 |

*Primary Examiner* — Adriana Figueroa
(74) *Attorney, Agent, or Firm* — Barnes & Thornburg LLP

(57) ABSTRACT

A gutter debris cover having an elongate first screening element with a plurality of diamond-shaped apertures having a major axis extending along the longitudinal length of the first screening element, and a second screening element having a plurality of finer apertures overlying the first screening element. The first screening element being formed in undulating manner across its width.

16 Claims, 5 Drawing Sheets

(56) References Cited

U.S. PATENT DOCUMENTS

| | | | | |
|---|---|---|---|---|
| 2012/0144759 | A1* | 6/2012 | Higginbotham et al. | 52/12 |
| 2013/0091780 | A1* | 4/2013 | Robins | 52/12 |
| 2013/0097943 | A1 | 4/2013 | Higginbotham | |
| 2013/0160378 | A1 | 6/2013 | Higginbotham | |
| 2013/0284650 | A1 | 10/2013 | Higginbotham | |
| 2014/0263001 | A1 | 9/2014 | Higginbotham | |

* cited by examiner

GUTTER DEBRIS COVER

BACKGROUND

The present disclosure relates to gutter debris covers for installation across a top opening of a rain gutter for roofs and other structures, and in particular to gutter debris covers adapted to allow water to pass through the gutter debris cover and into the gutter while inhibiting debris from passing through the gutter debris cover and into the gutter.

Gutters are common structures found along roof eves for collecting water from a roof and diverting it along a channel formed in the gutter to a downspout. Open-mouth gutters have a tendency to become clogged with debris that is captured in the gutter over time. It is therefore beneficial to prevent the accumulation of debris in a gutter to maintain water flow through the gutter.

BRIEF DESCRIPTIONS OF THE DRAWINGS

DETAILED DESCRIPTION

Figure 1:
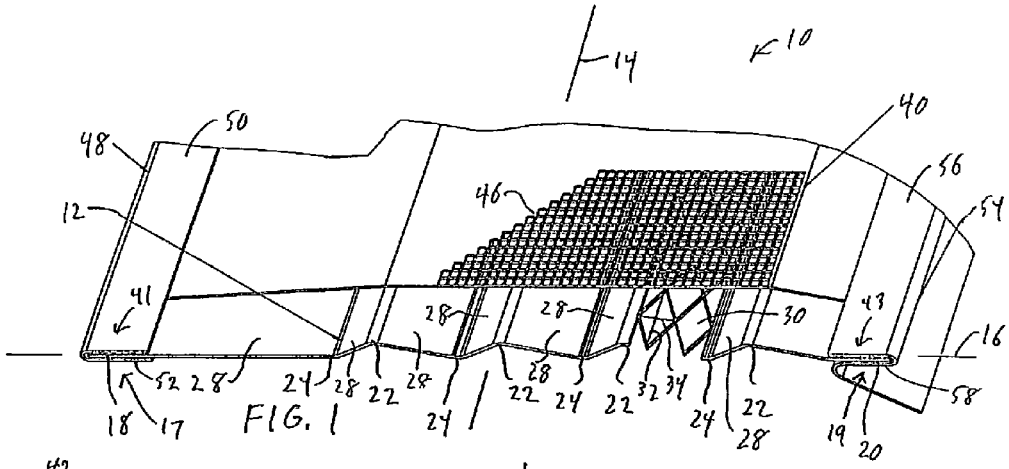
FIG. 1 is a perspective view of a gutter debris cover of the present disclosure.
Figure 2:
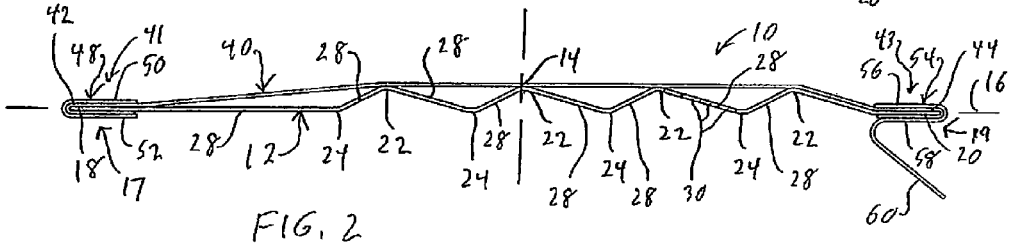
FIG. 2 is an end view of the gutter debris cover of FIG. 1.

The present disclosure relates to gutter debris covers adapted to be installed across a top opening of an open-mouth gutter. An embodiment of the gutter debris cover is shown in FIGS. 1 and 2 as gutter debris cover 10. Gutter debris cover 10 includes an elongate first screening element 12 having a generally linear longitudinal axis 14 and a generally linear transverse axis 16 that is generally transverse to longitudinal axis 14. First screening element 12 extends in an elongate manner generally parallel to longitudinal axis 14. First screening element 12 includes a first end 17 having a generally linear first side edge 18 and a second end 19 having a generally linear second side edge 20 that is spaced apart from and generally parallel to first side edge 18. First end 17 and first side edge 18 and second end 19 and second side edge 20 extend generally parallel to longitudinal axis 14.

As shown in FIG. 2, first screening element 12 extends transversely between first side edge 18 and second side edge 20 in a generally undulating, wave-like or corrugated manner such that the first screening element 12 includes a plurality of elongate ridges 22 and a plurality of elongate valleys 24 that extend generally parallel to one another and to longitudinal axis 14. The ridges 22 and valleys 24 alternate with one another as first screening element 12 extends from first side edge 18 toward second side edge 20. As shown in FIG. 2, ridges 22 are raised in height with respect to valleys 24. Longitudinal axis 14, ridges 22 and valleys 24 extend generally parallel to the longitudinal length of the gutter when the gutter debris cover 10 is installed in the gutter.

First screening element 12 includes a plurality of elongate panels 28 that extend longitudinally and generally parallel to longitudinal axis 14. Panels 28 are joined to one another along their side edges. Each panel 28 is disposed at a different angle of inclination with respect to its adjacent panel 28 thereby forming the undulating form of first screening element 12. Adjacent panels 28 that form a valley 24 also form a generally U-shaped or V-shaped channel that extends generally parallel to longitudinal axis 14.

First screening element 12 includes a plurality of apertures 30 that allow fluid, such as water, to flow therethrough from a top surface of first screening element 12 into the underlying channel of a gutter. Each aperture 30 includes a first or major axis 32 that extends generally parallel to longitudinal axis 14, and a second or minor axis 34 that extends generally transverse to major axis 32 and longitudinal axis 14. The apertures 30 may be generally circular or square such that the major axis 32 of each aperture 30 is equal in length to the minor axis 34 of the aperture 30. The apertures 30 may also be elongate apertures wherein the major axis 32 of each aperture 30 is longer in length than the length of the minor axis 34 of the aperture 30. Only one panel 28 is shown in FIGS. 1 and 2 as including apertures 30 for ease of illustration. However, each panel 28 may include a plurality of apertures 30.

Elongate apertures 30 may be formed as elongate generally diamond-shaped apertures having a major axis 32 and a minor axis 34 as shown in FIG. 1 with the major axis 32 being longer than the minor axis 34. Each of the diamond-shaped apertures as shown in FIG. 1 is formed by four generally linear legs that are connected end-to-end in a diamond-shaped pattern. The elongate apertures 30 may also be formed as elongate generally hexagonal-shaped apertures having a major axis and a minor axis, the hexagonal-shaped apertures being formed by two parallel and spaced apart legs and two legs at each end thereof in a generally V-shaped arrangement. Elongate apertures 30 may also be formed as elongate generally rectangular-shaped apertures, or elongate elliptical-shaped apertures, having a major axis and a minor axis with the major axis being longer than the minor axis. First screening element 12 comprises an open mesh structure. Major axis 32 of elongate apertures 30 is oriented generally parallel to longitudinal axis 14 to provide increased fluid flow through apertures 30 as fluid flows into the channels formed by the undulating first screening element 12.

If desired, a gutter debris cover 10 including only the first screening element 12 may be used to cover the open-mouth of a gutter. However, gutter debris cover 10 may additionally include a second screening element 40 that overlies first screening element 12. Second screening element 40 includes a first end 41 having an elongate first side edge 42 and second end 43 having an elongate second side edge 44 that is generally parallel to and spaced apart from first end and first side edge 42. First end 41 and first side edge 42 and second end 43 and second side edge 44 extend generally parallel to longitudinal axis 14. Second screening element 40 includes a plurality of apertures 46 that are adapted to allow fluid, such as water, to flow through second screening element 40 while inhibiting fine debris from flowing through second screening element 40. Apertures 46 may be circular, rectangular, diamond-shaped, or other configurations. Apertures 46 have a smaller opening area than the opening area of apertures 30 in first screening element 12. Second screening element 40 comprises an open mesh structure.

First side edge 42 at a first end 41 of second screening element 40 wraps around first side edge 18 of first screening element 12, such that a layer of second screening element 40 is respectively located above and below first side edge 18 of first screening element 12, and is coupled thereto. Second side edge 44 at a second end 43 of second screening element 40 wraps around second side edge 20 of first screening element 12, such that a layer of second screening element 40 is respectively located above and below second side edge 20 of first screening element 12, and is coupled thereto. As shown in FIG. 2, second screening element 40 is supported by the ridges 22 of first screening element 12. Second screening element 40 is spaced apart from the valleys 24 of first screening element 12 such that a gap is formed therebetween and such that a respective elongate channel is formed between each valley 24 of first screening element 12 and second screening element 40.

Second screening element 40 is supported across its width between first side edge 42 and second side edge 44 by ridges 22 of first screening element 12 and extends unsupported between adjacent ridges 22 of first screening element 12. Apertures 30 in first screening element 12 are thereby generally spaced apart from second screening element 40, and apertures 46 in second screening element 40 are generally spaced apart from first screening element 12, other than at ridges 22 and potentially at the side edges of the screening elements.

First end 41 and first side edge 42 of second screening element 40 is coupled to first side edge 18 of first screening element 12 by a fastener, such as a generally U-shaped clamping member 48 having a generally planar upper leg 50 and generally planar lower leg 52 spaced apart from and generally parallel to upper leg 50. Clamping member 48 clamps or crimps first end 41 and first side edge 42 of second screening element 40 and first end 17 and first side edge 18 of first screening element 12 together between legs 50 and 52. Clamping member 48 may extend continuously along first side edge 42 of second screening element 40, or a plurality of spaced-apart clamping members 48 may be used.

Second end 43 and second side edge 44 of second screening element 40 is coupled to second side edge 20 of first screening element 12 with a fastener, such as a generally U-shaped clamping member 54 having a generally planar upper leg 56 and a generally planar lower leg 58 spaced apart from and generally parallel to upper leg 56. Clamping member 54 clamps or crimps second end 43 and second side edge 44 of second screening element 40 to second end 19 and second side edge 20 of first screening element 12 between upper leg 56 and lower leg 58. Clamping member 54 may extend continuously along second side edge 44 of second screening element 40, or a plurality of clamping members 54 may be spaced apart from one another along second side edge 44. Clamping member 54 also includes an attachment member 60 that extends downwardly and outwardly from an outer edge of lower leg 58 of clamping member 54. Attachment member 60 is adapted to facilitate attachment of gutter debris cover 10 to the gutter.

Figure 3:
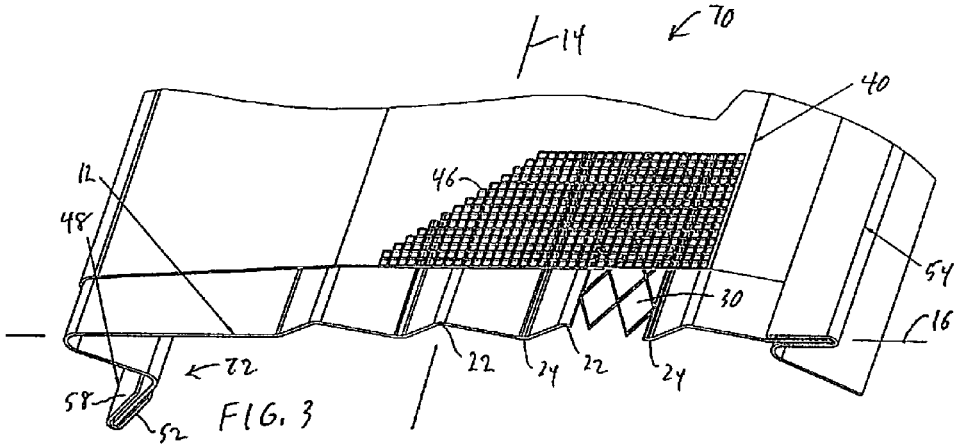
FIG. 3 is a perspective view of another embodiment of the gutter debris cover of the present disclosure.
Figure 4:
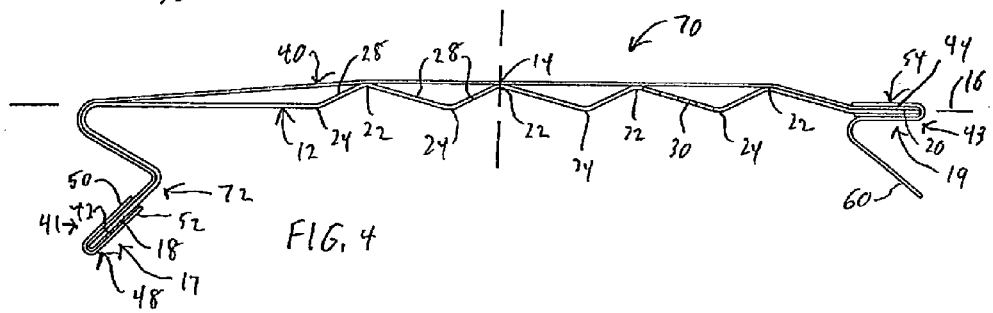
FIG. 4 is an end view of the gutter debris cover of FIG. 3.

Another embodiment of the gutter debris cover of the present disclosure is shown in FIGS. 3 and 4 as gutter debris cover 70. Gutter debris cover 70 as shown in FIGS. 3 and 4 includes many of the same components and features as gutter debris cover 10 and the same reference numbers are used in FIGS. 3 and 4. Gutter debris cover 70 includes an attachment member 72. Attachment member 72 is formed by first screening element 12 and second screening element 40 adjacent first side edge 18 of first screening element 12 and first side edge 42 of second screening element 40. Adjustment member 72 is generally V-shaped having a generally planar portion that extends downwardly and inwardly from an edge of the gutter debris cover 70 and a lower portion that extends downwardly and outwardly from a bottom end of the upper portion. Attachment member 72 is adapted to attach gutter debris cover 70 to the gutter.

First screening element 12 and second screening element 40 may be made from metal materials, such as stainless steel, aluminum or copper, or plastic materials. When first screening element 12 is made from a metal material that is different from the metal material from which the second screening element 40 is made, a coating may be applied to the metal material of the first screening element 12, such as by painting, anodization, or powder coating, such that the coating insulates the metal material of the first screening element 12 from the different metal material of the second screening element 40. The gutter debris covers 10 and 70 are installed across a top opening of an open-top gutter. The gutter debris covers 10 and 70 allow fluid, such as water, to flow therethrough into the underlying channel of the gutter while inhibiting debris from passing through the gutter debris cover into the gutter.

Figure 6:
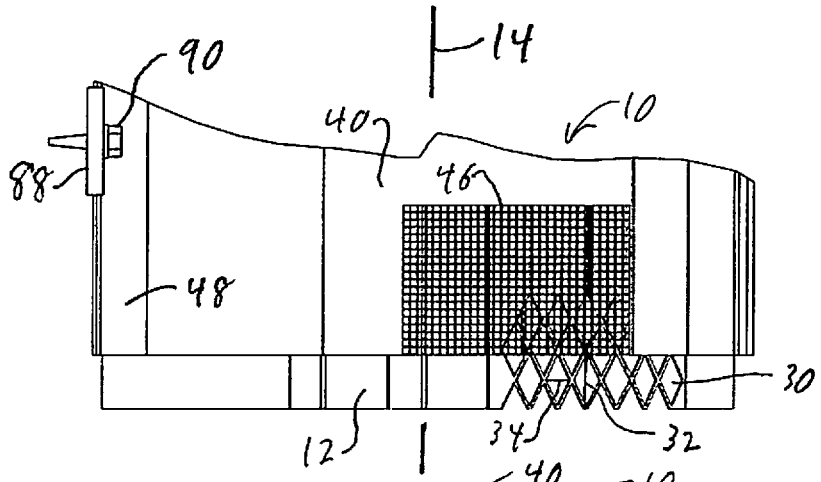
FIG. 6 is a top view of the gutter debris cover and gutter of FIG. 5.
Figure 5:
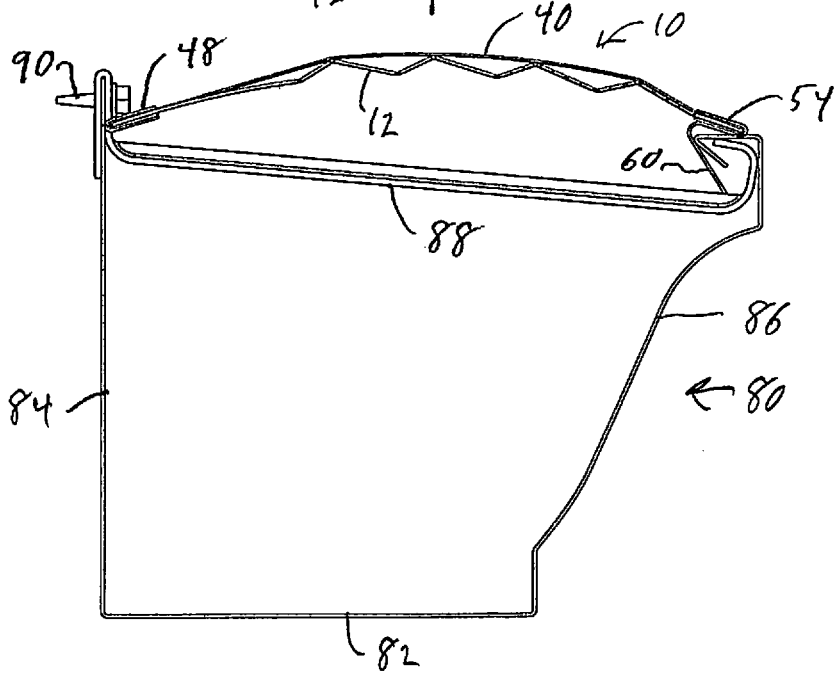
FIG. 5 is a cross-sectional view showing the gutter debris cover of FIG. 1 installed in a gutter.

FIGS. 5 and 6 show the gutter debris cover 10 of FIGS. 1 and 2 as installed across a top opening of an open-top gutter 80. Gutter 80 includes a bottom wall 82, a first side wall 84 and a spaced apart second side wall 86. Side walls 84 and 86 extend upwardly from bottom wall 82 to respective upper elongate edges. Gutter 80 includes an elongate fluid channel formed between first side wall 84 and second side wall 86 and above bottom wall 82. A gutter support 88, such as an elongate strap, extends between the upper edges of first side wall 84 and second side wall 86 and connects the upper edges together. A plurality of gutter supports 88 may be located, spaced apart from one another, along the longitudinal length of gutter 80. Fasteners 90 are adapted to couple first side wall 84 of gutter 80 to a structure, such as a roof eve. Attachment member 60 of gutter debris cover 10 couples gutter debris cover 10 to an upper edge of second side wall 86 of gutter 80. First side edge 18 of first screening element 12 and first side edge 42 of second screening element 40 are in wedged engagement with first side wall 84 of gutter 80 such that gutter debris cover 10 extends across the top opening of the gutter 80 and is coupled to gutter 80.

Figure 8:
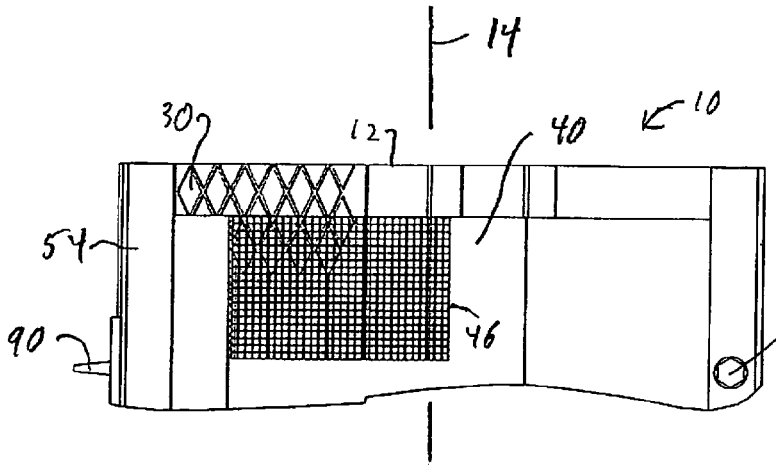
FIG. 8 is a top view of the gutter debris cover and gutter of FIG. 7.
Figure 7:
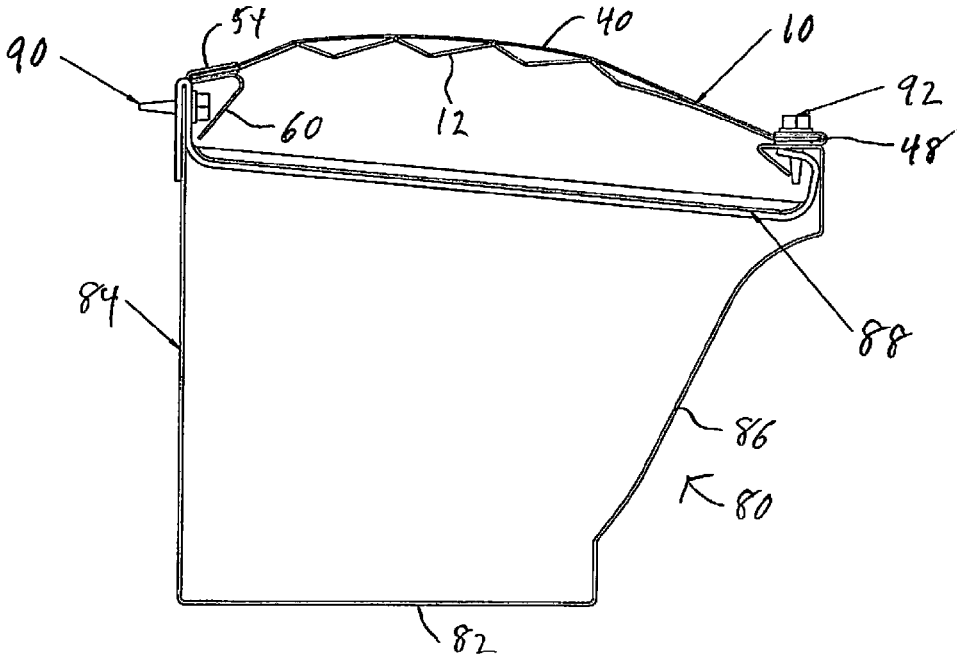
FIG. 7 is a cross-sectional view showing the debris cover of FIG. 1 installed in a reversed position in a gutter.

FIGS. 7 and 8 show the gutter debris cover 10 of FIGS. 1 and 2 installed across the top opening of the gutter 80. However, as opposed to what is shown in FIGS. 4 and 5, gutter debris cover 10 is rotated 180 degrees in a reversed manner such that first side edge 18 of first screening element 12, first side edge 42 of second screening element 40 and clamping member 48 are coupled to the top edge of second side wall 86 of gutter 80 by fastener 92. Second side edge 20 of first screening element 12 and second side edge 44 of second screening element 40 are coupled to the upper end of first side wall 84 of gutter 80 by attachment member 60.

Figure 10:
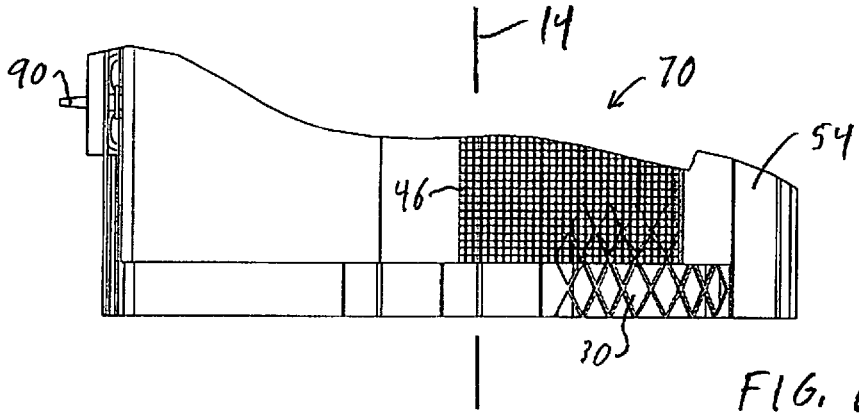
FIG. 10 is a top view of the gutter debris cover and gutter of FIG. 9.
Figure 9:
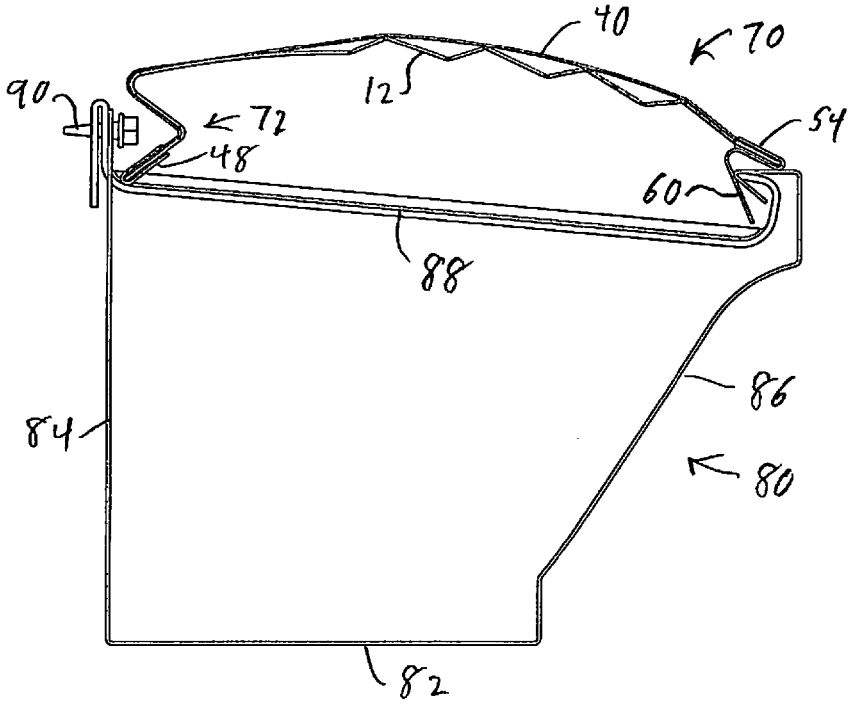
FIG. 9 is a cross-sectional view showing the gutter debris cover of FIG. 3 installed in a gutter.

FIGS. 9 and 10 show gutter debris cover 70 of FIGS. 3 and 4 installed across the top opening of gutter 80. Attachment member 60 couples gutter debris cover 70 to the top edge of second side wall 86 of gutter 80 and attachment member 72 couples gutter debris cover 70 to the top edge of first side wall 84 of gutter 80.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A gutter debris cover comprising:

an elongate first screening element adapted to be installed across a top opening of a gutter, said first screening element having a longitudinal axis, a first end, a second end, and a plurality of first apertures adapted to allow fluid to flow therethrough into the gutter, each first aperture having a first axis extending generally parallel to the longitudinal axis of said first screening element and a second axis extending generally transversely to said first axis of said first aperture, said first axis being equal to or longer than said second axis, said first screening element extending transversely in a generally undulating manner between said first end and said second end of said first screening element such that said first screening element includes one or more elongate ridges and one or more elongate valleys that extend generally parallel to said longitudinal axis of said first screening element;

a second screening element overlying said first screening element, said second screening element including a first end, a second end and a plurality of second apertures, said second apertures of said second screening element have smaller open areas than the open areas of said first apertures of said first screening element, said second screening element being supported by one or more of said ridges of said first screening element and spaced apart from one or more of said valleys of said first screen element such that an open elongate channel is respectively formed between each said valley of first screening element and said second screening element, each said open elongate channel having a transverse width between adjacent ridges that is longer than the distance between adjacent open elongate channels; and a first clamping member coupling said second screening element to said first end of said first screening element.

2. The gutter debris cover of claim 1 including a second clamping member coupling said second screening element to said second end of said first screening element.

3. The gutter debris cover of claim 1 wherein said first clamping member is generally U-shaped and includes a first leg and a second leg, said first end of said first screening element and said first end of said second screening element being located between said first leg and said second leg of said first clamping member.

4. The gutter debris cover of claim 1 wherein said first apertures of said first screening element comprise elongate first apertures wherein said first axis of each said elongate first aperture is longer than said second axis of said elongate first aperture.

5. The gutter debris cover of claim 4 wherein each said elongate first aperture is generally diamond-shaped.

6. The gutter debris cover of claim 4 wherein each said elongate first aperture is formed by four generally linear legs connected end-to-end in a diamond-shaped pattern.

7. The gutter debris cover of claim 4 wherein each said elongate first aperture is generally hexagonal-shaped.

8. The gutter debris cover of claim 1 wherein said first screening element is made from a metal material and includes a coating insulating the metal material of the first screening element from the second screening element.

9. The gutter debris cover of claim 1 wherein said first screening element includes a plurality of elongate panels, each panel extending transversely between a ridge and a valley of said first screening element.

10. The gutter debris cover of claim 1 wherein a gap is formed between each valley of said first screening element and said second screening element.

11. The gutter debris cover of claim 1 wherein said first end of said second screening element wraps around said first end of said first screening element and is clamped to said first end of said first screening element by said first clamping member, and said second end of said second screening element wraps around said second end of said first screening element.

12. The gutter debris cover of claim 1 including one or more attachment members for attaching said first screening member to the gutter.

13. A gutter debris cover comprising:

an elongate first screening element adapted to be installed across a top opening of a gutter, said first screening element including a longitudinal axis, a first end, a second end, and a plurality of first apertures adapted to allow fluid to flow therethrough into the gutter, said first screening element extending transversely in a generally undulating manner between said first end and said second end such that said first screening element includes one or more elongate ridges and one or more elongate valleys that extend generally parallel to said longitudinal axis of said first screening element, said first screening element including a plurality of elongate panels, each panel extending between a ridge and a valley of said first screening element;

a second screening element overlying said first screening element, said second screening element including a first end, a second end and a plurality of second apertures, said second screening element being supported by one or more of said ridges of said first screening element and being spaced apart from one or more of said valleys of said first screening element such that an open elongate channel is respectively formed between each said valley of said first screening element and said second screening element, each said open elongate channel having a transverse width between adjacent ridges that is longer than the distance between adjacent open elongate channels; and a first clamping member coupling said second screening element to said first end of said first screening element.

14. The gutter debris cover of claim 13 including a second clamping member coupling said second screening element to said second end of said first screening element.

15. The gutter debris cover of claim 13 wherein said first clamping member is generally U-shaped and includes a first leg and a second leg, said first end of said first screening element and said first end of said second screening element being located between said first leg and said second leg of said first clamping member.

16. The gutter debris cover of claim 13 wherein each said first aperture of said first screening element includes a first axis and a second axis, said first axis being equal to or longer than said second axis, said first axis extending generally parallel to said longitudinal axis of said first screening element.

* * * * *